US007013506B2

(12) United States Patent
Revels

(10) Patent No.: US 7,013,506 B2
(45) Date of Patent: Mar. 21, 2006

(54) CONVERTIBLE BED AND CABINET WITH REDUCED PROFILE

(76) Inventor: Ron Revels, 2411 Falls Ave. East, Twin Falls, ID (US) 83301-4491

( * ) Notice: Subject to any disclaimer, the term of this patent is extended or adjusted under 35 U.S.C. 154(b) by 30 days.

(21) Appl. No.: 10/915,992

(22) Filed: Aug. 10, 2004

(65) Prior Publication Data

US 2006/0031986 A1 Feb. 16, 2006

(51) Int. Cl.
*A47C 19/06* (2006.01)

(52) U.S. Cl. ..... 5/149; 5/155; 5/159.1; 5/160; 5/706

(58) Field of Classification Search ..... 5/160, 5/159.1, 155, 149, 136, 706, 713, 150.1
See application file for complete search history.

(56) References Cited

U.S. PATENT DOCUMENTS 791,857 A 6/1905 Arnold
3,097,369 A 7/1963 Emch
3,828,375 A 8/1974 Driver
3,852,837 A 12/1974 Eakins
3,858,253 A 1/1975 Lauzon
4,793,011 A 12/1988 Eve
5,601,348 A 2/1997 Minkovski
5,611,414 A 3/1997 Walker
5,913,769 A 6/1999 Byma et al.
D443,997 S 6/2001 Stout
6,425,151 B1 7/2002 Barnett

*Primary Examiner*—Alexander Grosz
(74) *Attorney, Agent, or Firm*—Derek H. Maughan; Dykas, Shaver & Nipper

(57) ABSTRACT

A storable sleeping bed made up of a foldable bed platform configured for folding storage within a cabinet, a plurality of vertical support pieces configured to support the bed. An air mattress configured to be inflated for use and deflated when storage is desired, and an air mattress. The entire assembly held within a cabinet, which has a thickness of less than twelve inches.

6 Claims, 5 Drawing Sheets

CONVERTIBLE BED AND CABINET WITH REDUCED PROFILE

BACKGROUND OF THE INVENTION

1. Field of the Invention

The present invention generally relates to foldable furniture, and more particularly to multiple use furniture such as foldaway beds that are housed within cabinets or other furniture.

2. Background Information

Folding beds of various types have been used for extended periods of time in the prior art. These beds are particularly useful in those situations where living space is cramped or where a single living space may be required to be used for a variety of living functions. An example of such a situation is a small one room apartment or similar living space where a party must sleep, eat, entertain, and live in the same small space. In many of these circumstances, various forms of furniture, such as the foldable beds or so-called Murphy beds, have been utilized to increase the available space and increase the various storage options available to the user. These same folding type beds are similarly useful in locations where a party wishes to provide a sleeping area for guests; however, they do not wish to dedicate an entire portion of a living area for that effect. These types of devices and embodiments are particularly useful in various instances such as hospital rooms.

One embodiment of the Murphy bed folds a bed into the wall of the room in which it is located. This feature greatly reduces the amount of bed that occupies floor space within the room when the bed is folded. However, this feature also has increased cost in that the wall of the room in which the device is located must be permanently changed in order to accommodate and receive the bed into the wall. This installation also makes these structures generally permanent in the location in which they are positioned. Other types of folding beds also exist wherein a bed folds into a piece of furniture that has the appearance of another piece of furniture or device such as a chair, chest or dresser. While these devices are generally more easily transportable, easier to put in place, and less permanent than those other devices that exist in the prior art, these devices also typically occupy a relatively large amount of floor space, which results in a cabinet that is significantly bulky, large, and in some cases aesthetically undesirable.

Of particular concern in these embodiments is the overall thickness of these devices. The thickness of these devices provides a profile that projects the front portion of these pieces of furniture a substantial distance from the back of the same piece of furniture. This projection causes a substantial portion of the floor space in the room to be taken up by the furniture itself. This is an undesirable result because it further limits the available living space in a typically cramped embodiment.

Another problem that exists in the prior art is that the foldaway furniture pieces in the prior art typically provide poor sleeping arrangements and sleeping support for the individuals who sleep upon these foldaway beds. This instability then leads to discomfort on the part of the individual sleeping on the foldaway bed. As a result, many individuals are hesitant to use foldaway beds because of the resulting pain and discomfort that occurs from their use.

Another problem that exists in the prior art folding bed cabinets is that many of these pieces are made from multiple folding pieces that pinch or injure the person that is folding the bed into or unfolding the bed from the piece of furniture in which the bed is stored. In addition, many times the devices that are folded out require locking mechanisms or other features that require a designated level of expertise and require time and knowledge in order to properly set up and secure the folding bed. As a result, many times such devices are inherently unsafe both to the person setting up the device as well as to the person sleeping on the bed due to the potential errors that could occur in the securing of the bed itself in a desired position.

Accordingly, it is an object of the present invention to simplify and enhance a folding bed and cabinet combination. It is another object of this invention to provide a folding bed that reduces the number of folding parts and simplifies the set up and take down of the folding bed. It is another object of the present invention to provide a folding bed cabinet with a reduced size and thickness therefore resulting in a cabinet that occupies less floor space than other cabinets that exist in the prior art. Another object of the present invention is to provide a bed that folds into a cabinet and while in a closed position, can be used as a utility bar or a counter. It is a further object of the invention to provide a self-supporting fold down bed that is safer to use than the other embodiments that exist in the prior art. It is also an object of the present invention to provide a storage cabinet that is configured to hold all of the required materials for sleeping including the bedding that is used with a mattress and which also utilizes a thinner profile within the living area itself as compared to the existing prior art devices. The present invention provides all of these features.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a storable sleeping cabinet having a cabinet portion comprised of two sides, a top, a bottom, and a back. The cabinet also has a front portion comprised of a lower face plate fixedly attached to the sides and an upper faceplate hingedly connected to the lower face plate through a hinge. The upper face plate further comprises a plurality of panels that are hingedly attached to a front surface of the upper face plate. These panels are configured to fold away from their generally horizontal position along the front surface, and to form a generally vertically oriented support plate to support the front panel when the front panel is oriented in a generally horizontal orientation. The sides of the cabinet are configured to have a horizontal dimension of less than twelve inches. The cabinet is further configured to define a chamber designed to hold an air compressor, bedding, and an air mattress therein. The cabinet portion of the sleeping bed also comprises a foldaway platform extension portion made up of an extension portion. The extension portion has a first end hingedly connected to a back portion of the upper face plate and extends to a second end. The extension portion is further connected to a support portion. The foot support portion is hingedly connected to the extension portion and is configured to fold away from the extension portion so as to form a generally vertical support to the extension portion of the device itself.

When the device is no longer in use and a party wishes to fold the bed into the cabinet for storage, this may be accomplished by simply raising the extension portion of the device and folding this portion on top of the upper portion of the front face plate portion of the device. When the extension portion is raised, the foot support portion folds downward and lies against the extension portion when the extension portion is laid upon the upper portion of the front faceplate. The upper portion of the front face plate is also configured to then be folded upward so as to contact the sides of the device. The lid of the device is then lifted and replaced over the top portion of the upper faceplate so as retain the upper face portion in a desired position and orientation.

In addition to the support platform, the inner portion of the cabinet portion of the device includes an air mattress, an air compressor to inflate the mattress, and appropriate bedding for the air mattress. The inclusion of an air mattress and associated materials provides a sleeping configuration that has a significantly lesser thickness than other devices that are taught in the prior art.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
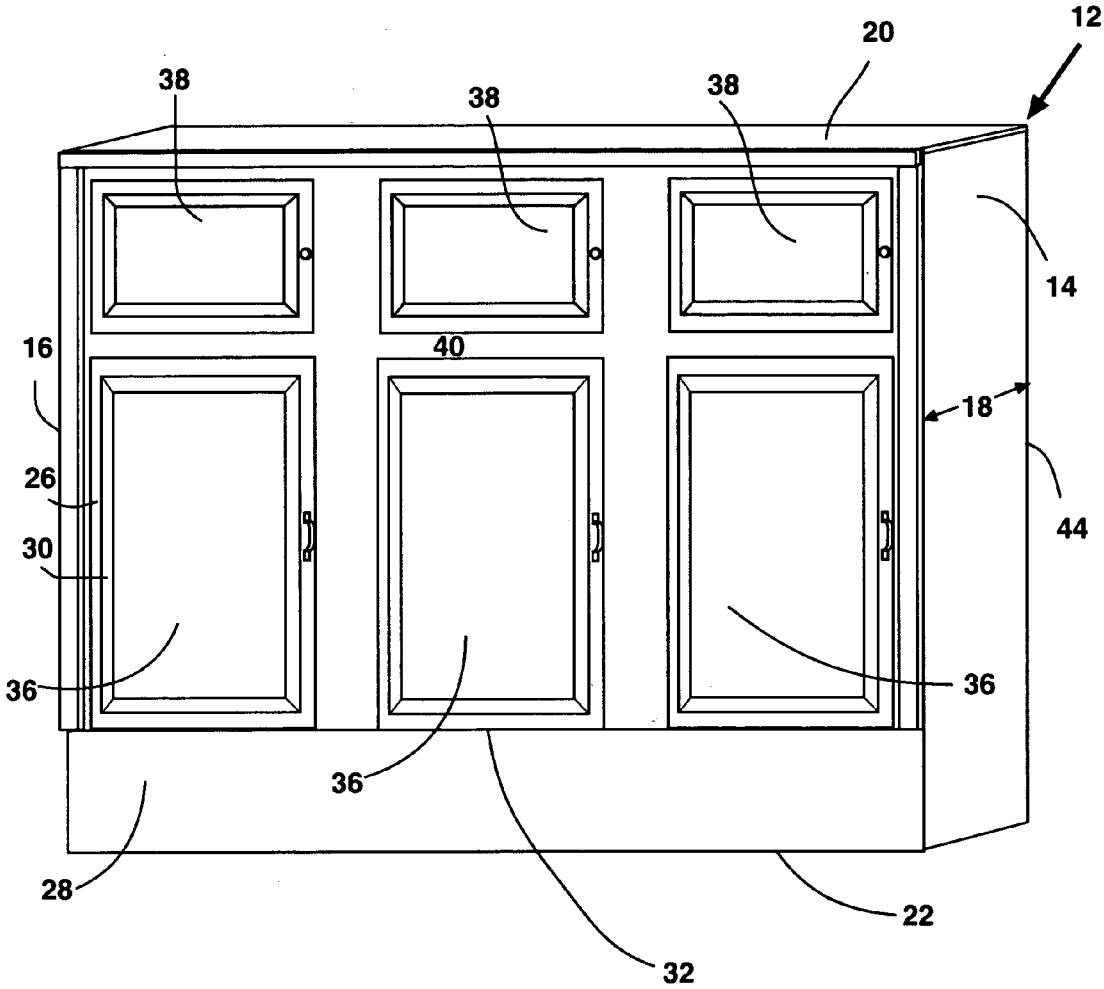
FIG. 1 is a perspective view of a preferred embodiment of the present invention in a closed position.

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the invention is to cover all modifications, alternative constructions, and equivalents falling within the spirit and scope of the invention as defined in the claims.

FIGS. 1–4 show a preferred first embodiment of the present invention. The present invention is a foldaway sleeping arrangement made up of a cabinet portion and an extension portion which folds away from the cabinet into a bed. The cabinet portion and the extension portion together define a sleeping surface adequate to support a sleeping mattress and bedding thereupon. Referring first to FIG. 1, a perspective view of the present invention in an upright folded orientation is shown. FIG. 1 shows a storage cabinet 12, the cabinet having two sides 14 and 16, each of the sides having a dimension 18 of less than twelve inches. The cabinet having a top 20, a bottom 22, a back 24 (not shown in this Figure), and a front 26. The front comprised of an upper face portion 30 and a lower face portion 28. On the front 26, the connection between the lower face plate 28 and the upper faceplate 30 is accomplished by a hinge 32.

In the preferred embodiment, this hinge 32 is a long piano hinge. However, it is to be specifically understood that depending upon the desires of the user, the configuration of this hinge may be variously embodied. In the preferred embodiment, a piano hinge is utilized so as to provide a continuous hinge that runs nearly the entire length of the upper face portion 30. This feature reduces the number of joints and gaps between the lower and upper face plates 28 and 30, and reduces the likelihood that items such as a person's fingers would be pinched within these gaps while folding or unfolding the bed. In the preferred embodiment, the upper face plate 30 and the extension 42 are made from a sturdy material. In the preferred embodiment this is wooden plywood having a thickness of at least one half inch. While this material is described in this description of the preferred embodiment, it is to be distinctly understood that the invention is not limited thereto but may be variously embodied to meet the specific needs of a user.

Figure 3:
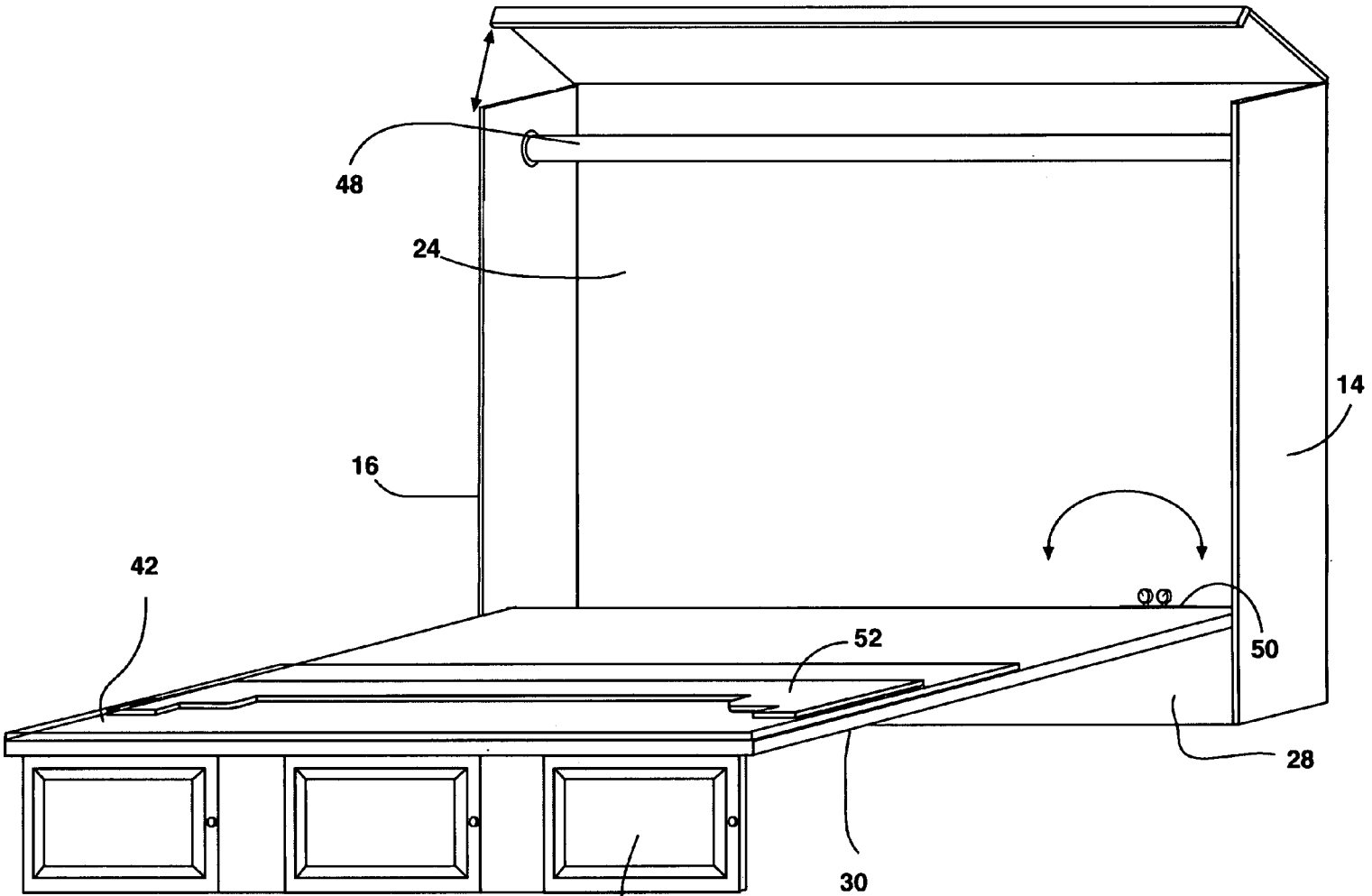
FIG. 3 is a perspective view of the embodiment shown in FIG. 2 with the upper face portion folded out from the cabinet.
Figure 4:
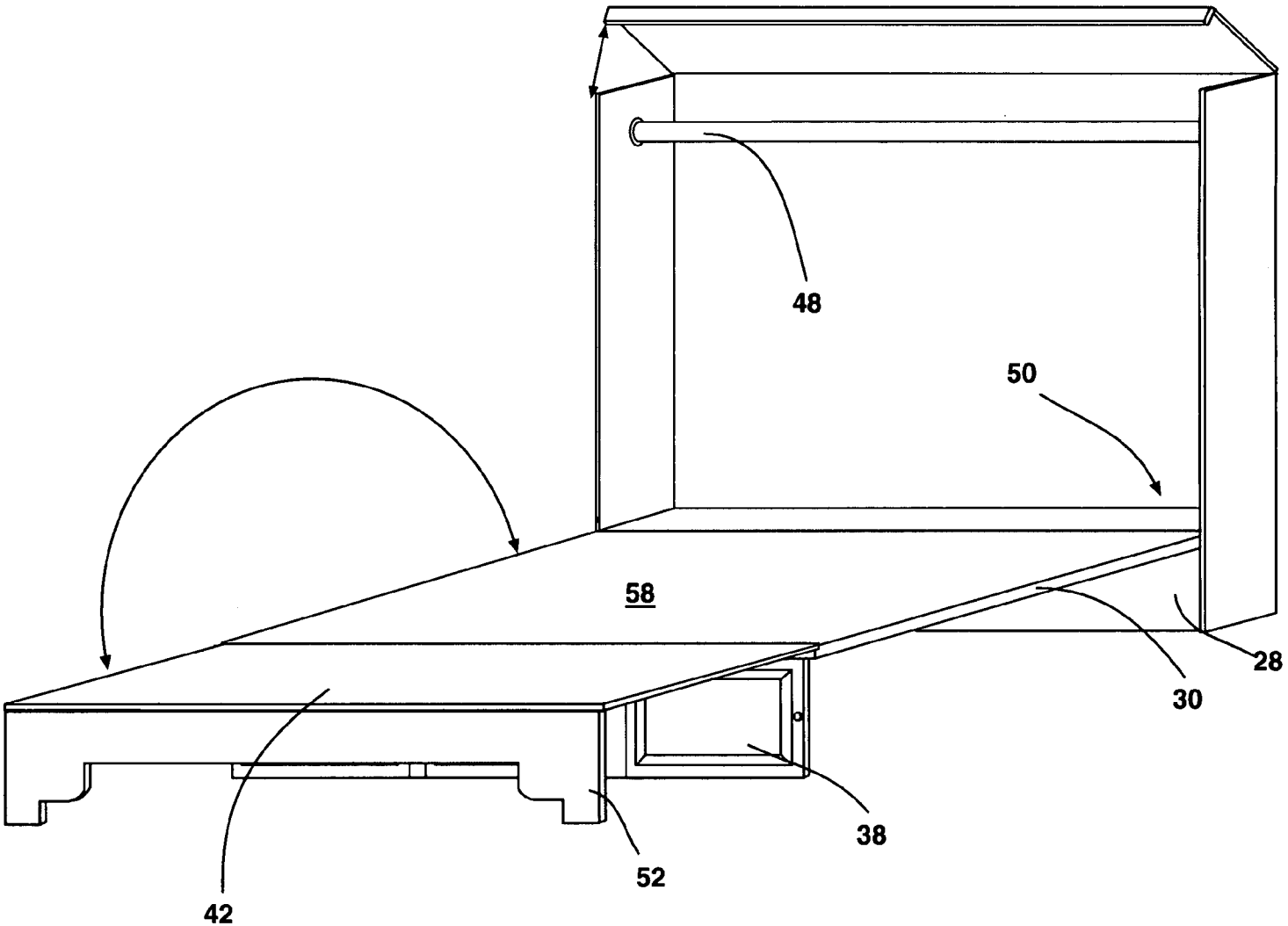
FIG. 4 is a view of the embodiment showing FIGS. 1–3 with the extended portion folded away.

The upper face plate 30 comprises a variety of short panels 38 and a variety of long panels 36. These long panels, in the preferred embodiment, are positioned for decorative purposes only. The short panels 38 are hingedly connected to the front surface 40 of the upper face plate 30. The panels 38 extend downward so that when the upper face portion 30 is moved from a generally vertical orientation, as shown in FIG. 1, to a generally horizontal orientation, as is shown in FIGS. 3 and 4, these panels 38 fold downward from the front face portion 40 and as such, form a support for the airbed mattress portion. In the preferred embodiment, when the device is folded into the storage cabinet embodiment shown in FIG. 1, the item occupies a significantly reduced amount of space as compared to the other devices that exist in the prior art.

Figure 2:
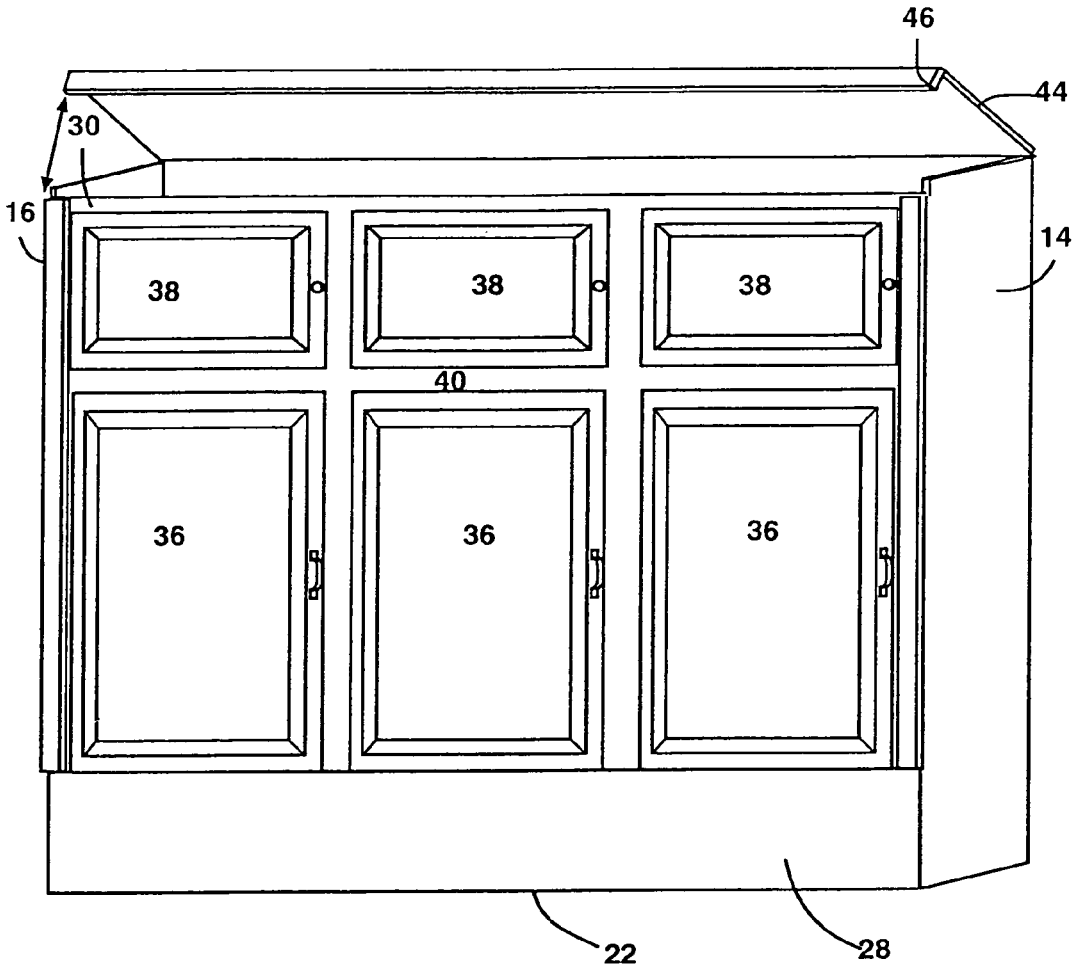
FIG. 2 is a view of the embodiment shown in FIG. 1 showing the lid in a raised position.

Referring now to FIG. 2, a view of the embodiment from FIG. 1 is shown with the lid 44 raised in an elevated position. In this position, the lid 44 has a lip 46, which in the configuration shown in FIG. 1 extends over a portion of the upper face plate 30 to hold the upper face plate in a desired vertical orientation. When a user wishes to access and use the foldaway bed, this lid 44 is raised and the upper face plate 30 will then be separated from the sides 14 and 16 of the cabinet. The lower face plate 28 remains in a fixed direction with the sides 14 and 16. With the upper portion 30 now released from engagement with the sides 14 and 16, the upper portion 30 can then be lowered and laid flat.

Referring now to FIG. 3, a view of the embodiment shown in FIG. 2 is now shown with the upper face plate 30 laid down in a generally horizontal orientation. In this configuration, the upper face plate 30 has been laid in a horizontal orientation while the lower face plate 28 remains connected to the sides 14 and 16 of the device. When this occurs, the short panels 38 fold away from the upper surface 30 and form generally vertically oriented braces, which assist to support and hold the platform forming portions of the device. In the preferred embodiment, the short panels are all interconnected together and fold up and down as one piece.

Referring now to FIG. 3, a view of the embodiment of the invention shown in FIG. 2 is shown. In this figure, the back portion 24 of the cabinet 10 is visible. Within the cabinet 10, a rod 48 is utilized to hold various features within the cabinet. For example, in the preferred embodiment, this rod 48 holds the bedding and the air mattress within the cabinet in a desired position and orientation, and allows these items to be easily accessed by a user at an appropriate time.

In addition, the cabinet 10 defines a container compartment 50, which defines an area wherein an air compressor is stored. In addition, additional space is also occupied within this area to hold an air mattress, pillows and other assorted bedding components. To further proceed with the setup of the bed, the extension portion 42 must be unfolded from the upper face portion 30. This step is shown in FIG. 4.

Figure 5:
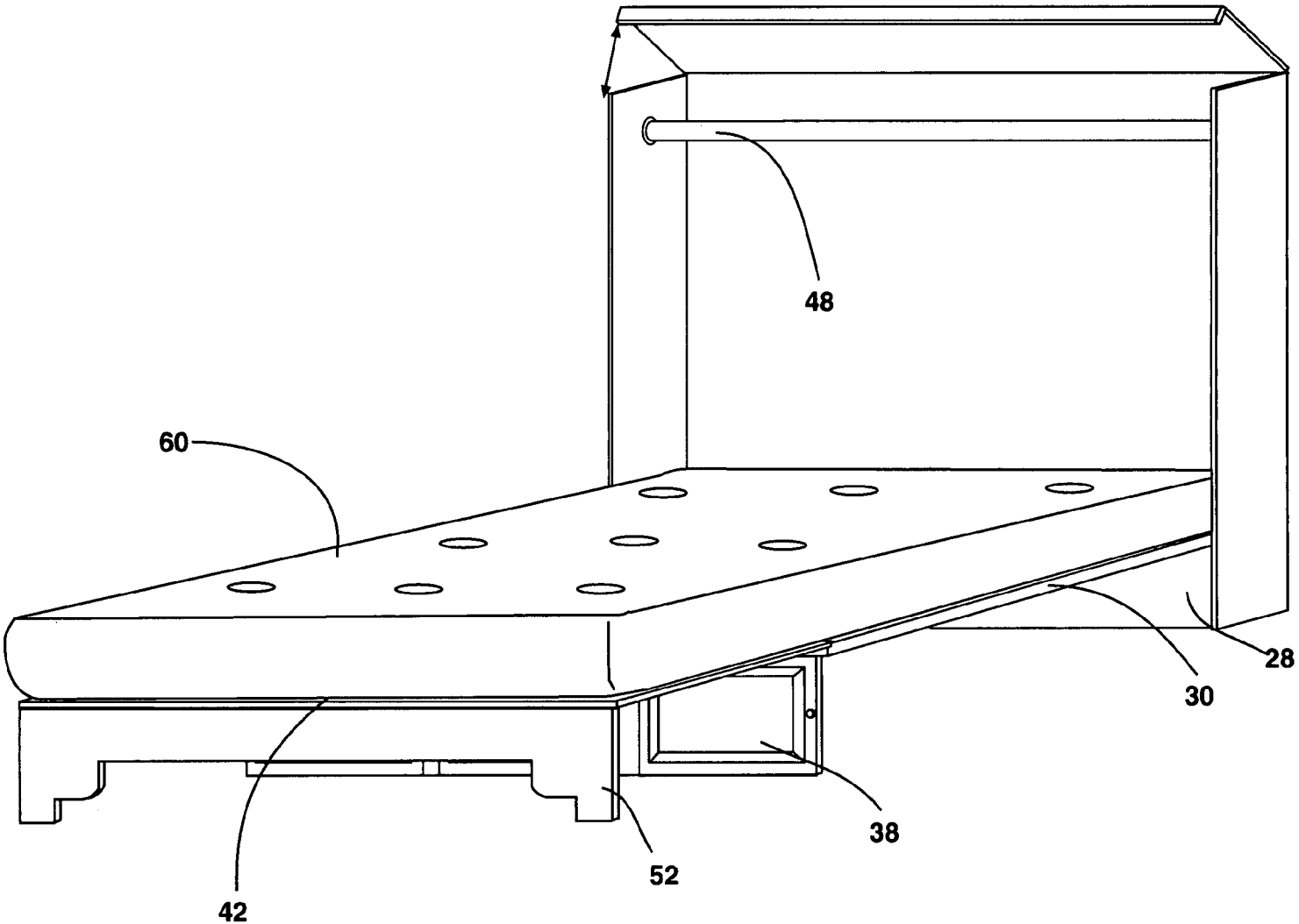
FIG. 5 is a view of the embodiment shown in FIGS. 1–4 with an air mattress in place upon the fold out platform.

In FIG. 4, the foldaway platform extension 42 is folded away from the horizontally oriented upper face plate 30. The foldaway platform extension 42 is then folded away from the upper face plate 30. A foot support 52, which is hingedly connected to the platform extension 42, then supports the extension portion 42 of the bed. When this extension platform 42 has then folded out of the cabinet 12 and is supported by a foot support 52, a sleeping surface is established. As seen in the figures, in the storage position, when upper face plate 30 is vertically oriented, extension portion 42, panel 38 and support portion 52 are all coplanar and contiguous therewith. As shown in FIG. 5, the air mattress 60 can then be removed from the container compartment 50, inflated utilizing the air compressor an air compressor and positioned upon the platform as desired. Bedding can then be placed upon the air mattress so as to accommodate the user.

The advantage of an air mattress 60 is that in addition to its ease of folding, the variable hardness of the air mattress itself can be modified to accommodate the specific desires of a user. This then allows a user to adjust and accommodate the bed to achieve the desired firmness that is specifically desired. The air mattress also enables the device to have a thinner profile and thus is a part of the preferred embodiment. However, it is to be distinctly understood that other types of mattresses could also be utilized in the present invention without departing from the scope of the claims of the present invention.

After a party has slept upon the mattress and the bed is no longer desired for use, the bed can be simply and easily stored. In the preferred embodiment, this is done by simply deflating the air mattress, removing the air mattress and returning the air mattress to the desired storage location within the cabinet. The bedding is similarly removed and placed in a desired storing position.

The sleeping surface is then folded by raising the extension portion 42 of the device and folding this portion 42 on top of the upper portion 30 of the front face plate portion 26 of the device. When the extension portion 42 is raised, the foot support portion 52 folds downward and lies against the extension portion 42 when the extension portion 42 is laid upon the upper portion 30 of the front face plate 26. The upper portion of the front face plate 26 is also then folded upward so as to contact the sides 14 and 16 of the device. The lid 44 of the device is then lifted and replaced over the top portion of the upper face plate 30 so as to retain the upper face portion 30 in a desired generally vertical position and orientation.

The present invention thus provides a foldaway bed that has fewer moving pieces than those in the prior art, is easier to use and occupies less space than other devices that exist in the prior art. The present invention overcomes several of the deficiencies that exist in the prior art and acceptance and allowance of the present application is respectfully requested.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A storable sleeping bed comprising:

a cabinet portion comprised of two sides, a top, a bottom and a back, said cabinet also having a front portion comprised of a lower face plate fixedly attached to said sides and an upper face plate hingedly connected to said lower face plate through a hinge, said upper face plate adapted to be moved from a generally vertical, to a generally horizontal orientation and further comprising at least one panel hingedly attached to a front surface of said upper face plate, said panel configured to fold away from said front surface to support the placement of said upper face plate in a generally horizontal direction and orientation, said sides of said cabinet having a horizontal dimension of less than twelve inches, said top, sides, back and front of said cabinet defining a chamber configured to hold an air compressor, bedding and an air mattress therein;

an extension portion hingedly connected to a portion of said upper face plate further connected to a support portion, said foot support portion hingedly connected to said extension portion; said face plate and said extension portion forming a sleeping surface the lower face plate, when in a generally vertical position, being generally contiguous and coplanar with the panel attached to its front surface, with the extension portion, and with the foot support portion;

an air mattress, said air mattress configured to be inflated when in use and deflated when storage is desired, said air mattress configured for inflation by an air compressor.

2. The storable sleeping bed of claim 1 wherein said top of said cabinet further comprises a lip that extends from a lower portion of said top, said lip configured to hold said upper face plate portion in a desired vertical location and position against said sides of said cabinet.

3. The storable sleeping bed of claim 1 wherein said top of said cabinet is hingedly connected to said back.

4. The storable sleeping bed of claim 1 wherein said cabinet further comprises a rod, said rod configured to allow the hanging storage of items within said cabinet.

5. The storable sleeping bed of claim 1 wherein said upper face plate comprise at least one short panel and at least one long panel, said short panel hingedly connected to said upper face plate and configured to fold away from said panel so as to form a vertically oriented support generally perpendicular to a longitudinal axis of said upper face plate when said upper face portion is oriented in a generally horizontal position.

6. The storable sleeping bed of claim 1 wherein said upper face plate and said extension portion are each made of plywood having a thickness of at least one half inch.

* * * * *